United States Patent [19]

Greer

[11] Patent Number: 5,042,379

[45] Date of Patent: Aug. 27, 1991

[54] ROTARY DIE HOLD DOWN ASSEMBLY

[76] Inventor: Larry J. Greer, 182 N. Greentrails Dr., Chesterfield, Mo. 63017

[21] Appl. No.: 261,918

[22] Filed: Oct. 24, 1988

[51] Int. Cl.[5] ..... B41F 5/00

[52] U.S. Cl. ..... 101/216; 101/150; 101/153

[58] Field of Search ..... 101/150, 153, 375, 377, 101/379, 380, 381, 383, 216, 219; 100/168, 169; 33/614, 616, 617, 618, 621, 623

[56] References Cited

U.S. PATENT DOCUMENTS

| | | | |
|---|---|---|---|
| 2,581,593 | 1/1952 | Luttenauer | 101/216 |
| 2,818,014 | 12/1957 | Jacquart | 101/377 X |
| 3,378,902 | 4/1968 | Hoexter | 101/375 X |
| 4,149,461 | 4/1979 | Simeth | 101/375 X |

*Primary Examiner*—Edgar S. Burr
*Assistant Examiner*—Moshe I. Cohen
*Attorney, Agent, or Firm*—Cohn, Powell & Hind

[57] ABSTRACT

A rotary die hold down unit (10) is carried between opposed sideframes (12) of a printing press and includes a clamping unit (14) carried by each sideframe and a cross member (22) extending between said clamping units. The clamping units each include a base (34) having quick-release pins (62) for attachment to the sideframes. The sideframes include vertical slots (18) and an elongate adjustment member (52), is received by an adaptor sleeve (48) threadedly connected to the base and extending into the sideframe slot, the adjustment member and the sleeve cooperating to provide coarse and fine adjustment capability of the adjustment member. The cross member includes pressure blocks (20) at each end received within the sideframe slots for engagement by the adjustment members, and a pair of spaced roller blocks (24) having rollers (26) engageable with the rotary die (32) respectively at points on each side of the axis of rotation of said rotary die.

9 Claims, 1 Drawing Sheet

ROTARY DIE HOLD DOWN ASSEMBLY

BACKGROUND OF THE INVENTION

This invention relates generally to a hold down assembly for a printing press die and particularly to a quick release hold down assembly which facilitates the rapid release and replacement of the die.

Web fed printing press dies which have on their surface engraved patterns are placed in contact with a hardened anvil cylinder with the web therebetween and the die requires a hold down unit to maintain contact between the die and the anvil cylinder. When a job is completed and a new job commenced it is necessary to replace the die and substitute it with a die of the same general characteristics but with a different engraved surface pattern.

In general, conventional hold down assemblies include adjusting screws for pressure adjustment of the die to insure that proper cutting pressure is achieved. Traditionally, die hold down assemblies for relatively wide web presses have been bulky and heavy and, in consequence, difficult to handle. Although lighter weight units have been provided for narrower web presses, both heavy and lightweight units have required considerable machining and have required cumbersome attachment to the press, usually by bolting. Invariably, the die pressure adjustment has utilized long threaded screws to provide adjustment for a wide range of die sizes at different die stations.

In consequence of the use of this type of hold down assembly, die replacement has been very time-consuming resulting in considerable downtime particularly in the case of short run jobs in which removal and replacement of dies may be required several times daily involving unbolting and rebolting of the unit and readjustment of the screw adjustment where a different size die is required.

In addition to the above problems, the use of one piece hold down assemblies, that is units spanning between the sides of the press, a further problem in that the size and configuration of the hold down assembly often prevents the operator from having a clear view of the web and interferes with trim removal.

The present hold down unit solves these and other problems in a manner not revealed by the known prior art.

SUMMARY OF THE INVENTION

This printing press rotary die hold down assembly is relatively lightweight, can be quickly installed and adjusted and can be used with a wide range of die sizes.

The unit can be easily installed by a single operator without the aid of lifting hoists, or the like, because of the use of separate hold down components on each sideframe which are removed by means of known quick-release clamping screws and quick release retention pins in conjunction with an improved cross bar means.

It is an aspect of this invention to provide a rotary die hold down assembly including a pair of opposed side support means; a rotary die disposed between the side support means and having an axis of rotation substantially perpendicular to said side support means; and a hold down means extending between and carried by said side support means and including a pair of clamping units each having a base, means connecting said base to an associated side support means, and an elongate adjustment member extending through the base, and an elongate cross member having first engagement means at each end engageable by the adjustment member and second engagement means intermediate the ends engageable with the rotary die.

It is an aspect of this invention to provide that the adjustment member includes a lower end, and the first engagement means includes a pressure block engageable by said lower end.

It is another aspect of this invention to provide that each side support means includes a slot having substantially vertical sides, and each pressure block is movable within an associated side support means slot.

Still another aspect of this invention is to provide that the second engagement means includes roller means disposed fore and aft of the axis of rotation of the rotary die.

Yet another aspect of this invention is to provide that the roller means includes a pair of roller blocks disposed in spaced relation on the cross member, each including a forward roller and a rearward roller engageable with the rotary die.

It is another aspect of this invention to provide that each side support means includes a substantially vertical slot and a pin-receiving opening on each side of said slot, and each clamping unit base includes a pair of quick-release pins receivable by said openings.

Another aspect of this invention is to provide that each side support means includes an upper face, an outside face and an inside face on each side of said slot, and each clamping unit base is substantially ell-shaped and includes an upper leg having an under face engageable with said side support means upper face and an inner face engageable, in the case of one unit, with said inside face of one support means and, in the case of the other unit, with the outside face of the other support means and said upper leg includes a threaded opening receiving an adaptor sleeve; said sleeve receiving said adjustable member in coarse adjustment relation and said adaptor sleeve being movable within said base in fine adjustment relation.

Still another aspect of this invention is to provide that each cross member includes a shaft, and each first engagement means includes a pressure block received by an associated slot in sliding relation and receiving an associate shaft end in rotatable relation; and yet another aspect to provide that each second engagement means includes a pair of spaced transversely disposed roller blocks mounted to the shaft and carrying spaced rollers disposed on opposite sides of the shaft and engageable with the die.

It is an aspect of this invention to provide a hold down unit which is relatively easy and inexpensive to manufacture, simple to install and effective in operation.

DESCRIPTION OF THE PREFERRED EMBODIMENT

Figure 1:
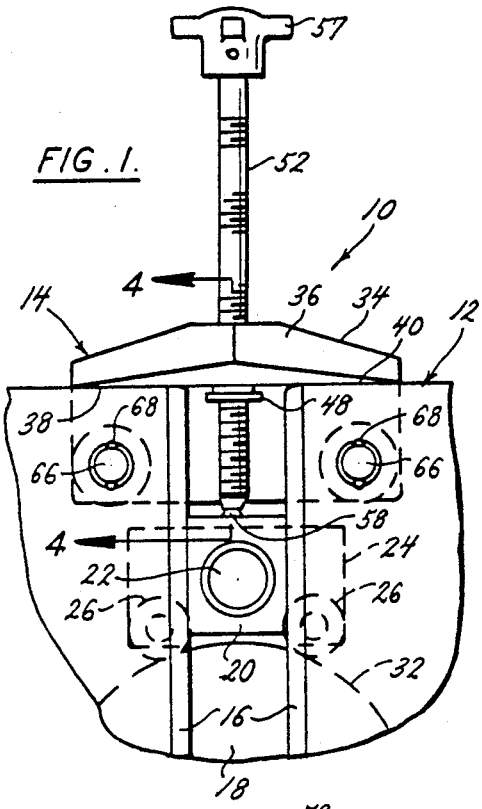
FIG. 1 is an elevational view of a hold down unit mounted to the sideframe of a printing press die station.
Figure 2:
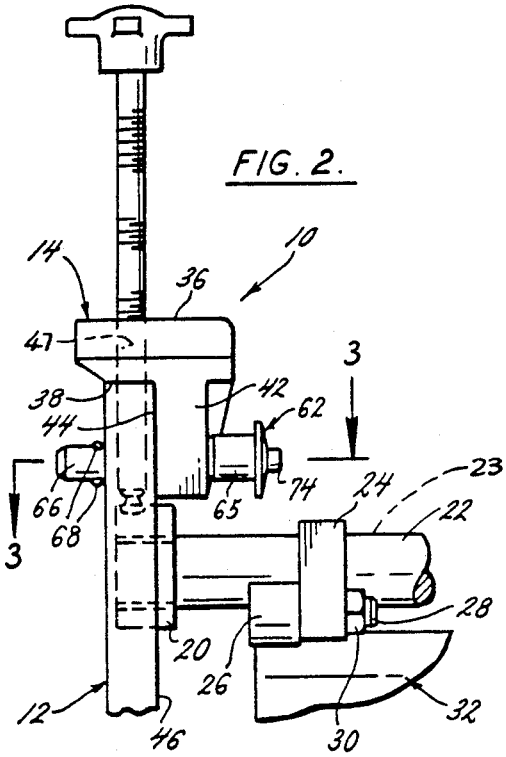
FIG. 2 is an end view of the unit.

Referring now by reference numerals to the drawing and first to FIGS. 1 and 2, it will be understood that the hold down unit generally indicated by numeral 10 is mounted between the sideframes 12 and 12' of a printing press die station.

The hold down assembly 10 includes a pair of identical clamping units 14 one unit, as shown, being mounted to the inside face of the gearside sideframe 12 and the other mounted to the outside face of the operator sideframe. This arrangement facilitates access to and removal of the assembly which is otherwise symmetrical and will be described with reference to the gearside sideframe 12. Each sideframe 12 and 12', which constitutes a side support means, includes opposed rails or gibs 16 defining a slot 18 receiving a generally rectangular pressure block 20 in sliding relation. The block 20 receives a cross member 22 in rotatable relation and constitutes first engagement. The cross member includes a shaft or bar 23 which carries a pair of opposed roller mounting blocks 24, constituting second engagement means, each block having fore and aft rollers 26, attached to said roller block by stub shafts 28 and nuts 30. The rollers 26 are disposed in rotatable relation to the rotary die 32 and the pressure of the rollers 26 on the die 32 is adjustable, as will now be discussed.

The clamping units 14 are of the type manufactured by Carr Lane of St. Louis, Mo. and known commercially as Bar-Loks. Each clamping unit includes a base 34 of generally ell-shaped cross section having an upper leg 36 having an underside face 38 seated on the upper edge 40 of the sideframe 12 and depending leg 42 having an inner face 44 disposed adjacent the inside face 46 of the sideframe 12.

Figure 4:
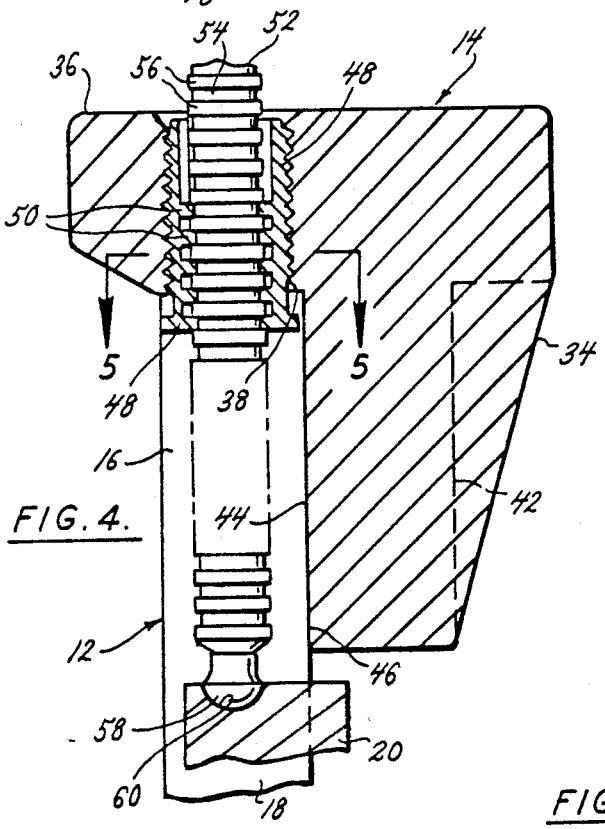
FIG. 4 is a fragmentary cross sectional view taken on line 4—4 of FIG. 1.

The base upper leg 36, as best shown in FIG. 4, includes an opening 47 which is threaded to receive an adaptor sleeve 48 in adjustable relation. The externally threaded sleeve 48 includes a plurality of internal sets of circumferentially spaced lands indicated by number 50 and disposed lengthwise of the sleeve, each set including four (4) lands in the embodiment shown. The sleeve 48 is adapted to receive an adjustment member 52 having a substantially square stem 54 with a circular core, said stem thereby defining a plurality of circumferentially spaced sets of lands 56 disposed lengthwise of the stem 54. This arrangement of compatibly spaced lands 50 and 56 provides that the adjustment member 52 can be rotated such that the stem lands 56 are clear of the sleeve lands 50 so that stem 54 can be moved rapidly in and out of the sleeve 48. This structural arrangement of parts provides coarse adjustment of the stem relative to the base. It also provides that the stem 54 and sleeve 48 can be rotated together, when the lands 56 and 50 engage and downward pressure is applied to the stem 50, to provide fine adjustment of the stem relative to the base 34 by virtue of the threaded relationship of the adaptor sleeve 48 within its associated sideframe opening 47. The ability of the adjustment member to rotate the sleeve thereby provides the adjustment member with fine adjustment in the nature of a pressure screw. The adjustment member 52 includes a handle 57 at the upper end and a ball point 58 at the lower end engageable within a depression 60 provided in the upper edge of the block 20.

Figure 3:
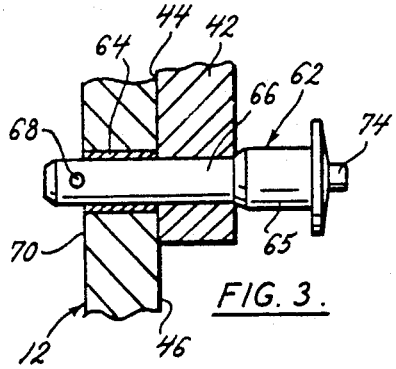
FIG. 3 is a fragmentary cross sectional view of the retention pins taken on line 3—3 of FIG. 2.
Figure 5:
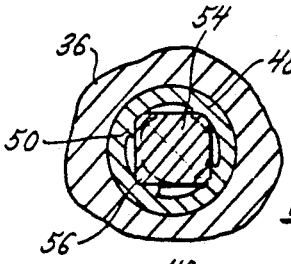
FIG. 5 is a fragmentary cross sectional view taken on line 5—5 of FIG. 4 showing the clamping screw in one position.
Figure 6:
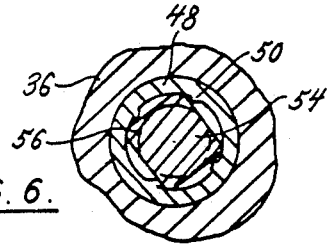
FIG. 6 is a similar view to FIG. 5 but showing the clamping screw rotated to a different position.

The base depending leg 42 as best shown in FIG. 3 is apertured to receive a pair of lock pins 62 in tight, substantially fixed relation and the sideframe 12 is apertured and provided with bushings 64 to receive said pins 62. Each pin 62 includes a head 65 and a shaft 66, said shaft 66 being provided with quick release ball locks 68 disposed in predetermined spaced relation from the underside of the head 65 such that when the outwardly disposed the ball locks 68 engage the outer face 70 of the sideframes 12, the clamping unit 14 is locked in place. As will be readily understood the ball locks 68 are retractible by actuation of the lock pin button 74 which provides for rapid removal of the lock pins 62, and therefore of the clamping units 14, from the sideframes 12. While the clamping units 14, including the lock pins 62, provide an integral part of the hold down unit 10 the clamping units are not in themselves new and manufactured by Carr Lane Manufacturing Co. of St. Louis, Mo. under the trademark Bar-Lock. The units are shown in the Carr Lane Catalog entitled Component Parts of Jigs and Fixtures (Rev. 5-85) page 15 which is incorporated herein by reference.

It will be understood that with this hold down assembly die replacement is a very simple and can easily be performed by a single press operator. The operator simply disengages the adjustment members 52 and releases the associated ball lock pins 62 with thumb press to remove the clamping units 14, access being facilitated by the unsymmetrical mounting arrangement. It is then possible to lift the cross bar 22 together with the pressure blocks 20 and roller blocks 24 as a unit. To reinstall the hold down assembly following replacement of the die 32 the procedure is reversed. The use of pressure blocks with the clamping unit adjustment screws provides for automatic alignment of the hold down assembly.

In view of the above it will be understood that various aspects and features of the invention are achieved and other advantageous results are attained. While a preferred embodiment of the invention has been shown and described, it will be clear to those skilled in the art that various modifications may be made without departure from the invention in its broader aspect.

I claim as my invention:

1. In a rotary die hold down assembly:

(a) a pair of opposed side support means, (b) a rotary die disposed between the side support means and having an axis of rotation substantially perpendicular to said side support means;

(c) a hold down means extending between and carried by said side support means and including:

(i) a pair of clamping units each having a base, means connecting said base to an associated side support means, and an elongate adjustment member extending through the base, and (ii) an elongate cross member having first engagement means at each end engageable by the adjustment member and second engagement means intermediate the ends engageable with the rotary die.

2. A hold down assembly as defined in claim 1, in which:

(d) the adjustment member includes a lower end, and (e) the first engagement means includes a pressure block engageable by said adjustment member lower end.

3. A hold down assembly as defined in claim 2, in which:

(f) each side support means includes a slot having substantially vertical sides, and (g) each pressure block is movable within an associated side support means slot.

4. A hold down assembly as defined in claim 1, in which:

(d) the second engagement means includes roller means disposed fore and aft of the axis of rotation of the rotary die.

5. A hold down assembly as defined in claim 4, in which:

(e) the roller means includes a pair of roller blocks disposed in spaced relation on the cross member, each including a forward roller and a rearward roller engageable with the rotary die.

6. A hold down assembly as defined in claim 1, in which:

(d) each side support means includes a substantially vertical slot and a pin-receiving opening on each side of said slot, and (e) each clamping unit base includes a pair of quick-release pins receivable by said openings on each side of said slot.

7. A hold down assembly as defined in claim 6, in which:

(f) each side support means includes an upper face, an outside face and an inside face on each side of said slot, and (g) each clamping unit base is substantially ell-shaped and includes an upper leg having an under face engageable with said side support means upper face and an inner face engageable, in the case of one unit, with said inside face of one support means and, in the case of the other unit, with the outside face of the other support means and said upper leg includes a threaded opening receiving an adaptor sleeve; said sleeve receiving said adjustable member in coarse adjustment relation and said adaptor sleeve being movable within said base in fine adjustment relation.

8. A hold down assembly as defined in claim 1, in which:

(d) each side support means includes a substantially vertical slot, (e) each cross member includes a shaft, and (f) each first engagement means includes a pressure block received by an associated slot in sliding relation and receiving an associate shaft end in rotatable relation.

9. A hold down assembly as defined in claim 8, in which:

(g) each second engagement means includes a pair of spaced transversely disposed roller blocks mounted to the shaft and carrying spaced rollers disposed on opposite sides of the shaft and engageable with the die.

* * * * *